US009376864B2

(12) United States Patent
Hsieh

(10) Patent No.: US 9,376,864 B2
(45) Date of Patent: Jun. 28, 2016

(54) DOOR CURTAIN ANTI-DROPPING DEVICE FOR ELECTRIC ROLLING DOOR

(71) Applicant: Chung-Hsien Hsieh, New Taipei (TW)

(72) Inventor: Chung-Hsien Hsieh, New Taipei (TW)

( * ) Notice: Subject to any disclaimer, the term of this patent is extended or adjusted under 35 U.S.C. 154(b) by 15 days.

(21) Appl. No.: 14/275,717

(22) Filed: May 12, 2014

(65) Prior Publication Data

US 2014/0332172 A1 Nov. 13, 2014

(30) Foreign Application Priority Data

May 13, 2013 (TW) ..... 102116875 A

(51) Int. Cl.

| | |
|---|---|
| ***E06B 9/84*** | (2006.01) |
| ***E06B 9/08*** | (2006.01) |
| *E06B 9/80* | (2006.01) |
| *E06B 9/70* | (2006.01) |
| *E06B 9/68* | (2006.01) |

(52) U.S. Cl.

CPC ... *E06B 9/84* (2013.01); *E06B 9/08* (2013.01); *E06B 9/70* (2013.01); *E06B 2009/6809* (2013.01); *E06B 2009/807* (2013.01)

(58) Field of Classification Search

CPC ..... E06B 9/84; E06B 9/08; E06B 9/70; E06B 2009/6809; E06B 2009/807; E06B 9/80; E06B 9/82; E05Y 2201/20; E05Y 2201/21; E05Y 2400/20; E05Y 2400/36; E05Y 2400/514; E05Y 2201/408; E05Y 2400/532; E05Y 2400/302; F16D 59/02; F16D 2121/22; F16D 65/18; F16D 2125/40; F16D 2121/18; F16D 2121/28; F16D 2121/30; B60T 13/746; B60T 13/741; H02K 49/043; H02K 49/04; B60L 7/00

USPC ..... 160/188, 291, 296, 8, 1; 188/156–164, 188/72.4–72.8

See application file for complete search history.

(56) References Cited

U.S. PATENT DOCUMENTS

| | | | | |
|---|---|---|---|---|
| 2,755,081 A * | 7/1956 | Johnson | ..... | E05F 15/67 160/188 |
| 3,637,004 A * | 1/1972 | Wardlaw | ..... | E06B 9/84 160/133 |

(Continued)

FOREIGN PATENT DOCUMENTS

| | | |
|---|---|---|
| TW | 250156 | 6/1995 |
| TW | M324708 | 1/2008 |

OTHER PUBLICATIONS

Search Report 102116875, TW.

*Primary Examiner* — Katherine Mitchell
*Assistant Examiner* — Johnnie A Shablack
(74) *Attorney, Agent, or Firm* — Bui Garcia-Zamor; Jessica H. Bui, Esq.

(57) ABSTRACT

A door curtain anti-dropping device comprises at least one rotating shaft, a brake mechanism, a rotational speed detecting module, and a control circuit, the rotating shaft being coupled to the winding shaft, the brake mechanism being used to brake the rotating shaft, the rotational speed detecting module being used to detect the rotational speed of the rotating shaft. When the door operator drives the winding shaft to rotate, the control circuit controls the brake mechanism to release the brake and to drive the rotating shaft and winding shaft. Once the chain is broken, an abnormal rotational speed of the winding shaft is detected by the rotational speed detecting module, the control circuit switches off the power source immediately to make the brake mechanism lock the winding shaft.

18 Claims, 6 Drawing Sheets

(56) References Cited

U.S. PATENT DOCUMENTS 3,802,281 A * 4/1974 Clarke ..... F16H 25/2021 192/223
4,059,339 A * 11/1977 Brown ..... G03B 21/58 160/310
4,172,563 A * 10/1979 Werner ..... E06B 9/72 160/310
4,220,051 A * 9/1980 Catlett ..... E05F 1/105 49/137
4,333,270 A * 6/1982 Catlett ..... E05F 1/105 49/336
4,416,355 A * 11/1983 Sanford ..... B65H 23/06 188/171
4,513,805 A * 4/1985 Mase ..... E06B 9/80 160/299
4,613,023 A * 9/1986 Fairbairn ..... B64C 13/38 188/134
4,697,676 A * 10/1987 Haake ..... E06B 9/84 192/148
4,788,463 A * 11/1988 Layh ..... F16D 51/00 188/161
4,838,333 A * 6/1989 Mottura ..... E06B 9/80 160/296
5,186,286 A * 2/1993 Lindberg ..... F16D 55/28 188/161
5,501,117 A * 3/1996 Mensing ..... F16H 1/125 74/420
5,551,535 A * 9/1996 Krolo ..... E05D 13/003 188/346
5,836,076 A * 11/1998 Duta ..... F16H 57/023 29/407.05
6,055,885 A * 5/2000 Shea ..... E06B 9/74 160/310
6,328,655 B1 * 12/2001 Zimmermann ..... F16H 57/025 464/170
6,328,665 B1 * 12/2001 Gormley ..... E04H 12/2246 108/161
6,688,438 B2 * 2/2004 Bucher ..... H02K 7/102 188/185
6,776,396 B2 * 8/2004 Miyoshi ..... B66B 11/0453 187/296
7,055,283 B2 * 6/2006 Hsieh ..... E05F 15/40 160/188
7,275,631 B2 * 10/2007 Hsieh ..... E06B 9/82 160/9
7,341,129 B2 * 3/2008 Hsieh ..... E05F 15/40 160/188
7,367,891 B2 * 5/2008 Bae ..... B64C 13/24 192/223.2
7,610,719 B2 * 11/2009 Hsieh ..... E05F 1/006 160/1
7,686,150 B2 * 3/2010 Hsieh ..... E06B 9/70 160/297
7,699,144 B2 * 4/2010 Hsieh ..... E05F 1/006 160/9
7,706,067 B2 * 4/2010 Liang ..... G03B 21/58 359/461
8,051,960 B2 * 11/2011 Nakajima ..... E06B 9/80 160/299
8,100,163 B2 * 1/2012 Nicholson ..... E06B 9/62 160/296
8,133,143 B2 * 3/2012 Schoon ..... H02K 7/1025 180/371
8,230,759 B2 * 7/2012 Hsieh ..... E05D 13/003 160/310
8,357,066 B2 * 1/2013 Lee ..... E06B 9/84 475/261
8,484,897 B2 * 7/2013 Hsieh ..... A62C 2/24 160/2
8,567,573 B2 * 10/2013 Hsieh ..... E06B 5/16 160/9
8,657,096 B2 * 2/2014 Hsieh ..... E06B 9/80 188/171
8,662,140 B2 * 3/2014 Hsieh ..... E05F 11/54 160/133
8,833,526 B2 * 9/2014 Goto ..... B60T 13/741 188/1.11 E
8,985,181 B2 * 3/2015 Hsieh ..... E06B 9/42 160/133
2003/0000796 A1 * 1/2003 Kawai ..... F16D 41/067 192/223.2
2003/0042084 A1 * 3/2003 Kawase ..... F16D 55/00 188/72.1
2005/0082870 A1 * 4/2005 Chikata ..... E05F 15/63 296/146.2
2008/0210386 A1 * 9/2008 Neuhaus ..... E06B 9/08 160/133
2012/0145335 A1 * 6/2012 Panseri ..... E05D 13/003 160/2
2013/0048443 A1 * 2/2013 Muramatsu ..... F16D 65/18 188/72.1
2014/0060754 A1 * 3/2014 Hsieh ..... A62C 3/14 160/7
2014/0191627 A1 * 7/2014 Takahashi ..... G01L 1/122 310/68 B
2014/0332172 A1 * 11/2014 Hsieh ..... E06B 9/84 160/133

* cited by examiner

DOOR CURTAIN ANTI-DROPPING DEVICE FOR ELECTRIC ROLLING DOOR

BACKGROUND OF THE INVENTION

1. Field of the Invention

The present invention relates to a door curtain anti-dropping device for an electric rolling door, and particularly, to a door curtain anti-dropping device driven by a winding shaft of a rolling door, wherein when a door operator chain is broken such that door curtain drops down with an abnormal speed, the anti-dropping device can lock the winding shaft immediately.

2. Description of the Related Art

For a rolling door, generally, it is quite heavy. Especially, for a large-sized warehouse door, it can reach even up to several tons. Hence, once it drops down vertically out of control, its destruction and lethality is very horrible. Therefore, building code basically has requirements for a rolling door design. That is to say, when a door curtain is moved up or down, the possibility of dangers caused by human factors or non-human factors, shall not happen. According to the inventor's practical experience, the main factors of potential dangers comprise: power outage and broken chain which can make the door curtain drop down by its own weight. As such, a conventional rolling door is installed with a preloading mechanism for balancing partial weight of the door curtain. However, it can be understood that the preloading mechanism only keeps the door curtain balance at the upper end point or the bottom end point. Once the door curtain departs from the upper end point, if it loses control, the door curtain still drops downward under the influence of the gravity.

Many known related documents for preventing the door curtain from dropping down abnormally are proposed. For example, as shown in FIGS. 6 and 6*a*, which are copied from U.S. Pat. No. 7,686,150 by the present inventor, a safety door speed limiting device comprises an input force shaft (10'), one end of which is driven by a door operator (1') so as to drive a hollow shaft (20') and a third shaft (23') via a first gear (11') and a second gear (12') disposed at the other end of the input force shaft (10'), the hollow shaft (20') receiving and securing one end of a winding shaft (4') at its center, and the third shaft (23') connecting to an extension shaft (25'); a braking device (3'), including a drive gear (31') firmly connected to the extension shaft (25'); a driven shaft (33'), pivoting on a shaft hub (35'), the shaft hub (35') being firmly connected to the winding shaft (4') and rotating together with the hollow shaft (20'); an idle gear (37'), located between the drive gear (31') and the driven gear (33') to adjust the rotational speeds of the driven gear (33') and the hollow shaft (20') to be coincident; a clutch mechanism (39') with a cam (36') disposed on the shaft hub (35'), on the circumference of the cam (36'), there being a plurality of protrusions (361') and recesses (362'), one end of the driven gear (33') including a plurality of tabs (34') and a plurality of notches (341') to surround the cam (36'); and a plurality of rollers (38'), located in the notches (341') among the tabs (34') and corresponding to the recesses (362') of the cam (36'), respectively, wherein the clutch mechanism (39') further includes a secured limitation part (32') for limiting the cam (36'), the tabs (34') and the rollers (38') to run in a space. Accordingly, in the case of no potential difference between the rollers (38') and the cam (36'), the driven gear (33') and the shaft hub (35') are constrained to run synchronously. When the rotational speed of the winding shaft (4') has an abnormal change, the dislocation between the rollers (38') and the cam (36') is created immediately to lock the shaft hub (35') and brake the winding shaft (4').

The above-mentioned patent can lock the winding shaft, when the door curtain drops down abnormally. However, once the winding shaft is locked, it is quite troublesome to unlock the lock state of the winding shaft. It is necessary to dismantle the door operator, and therefore, there is still a room for the mechanism to improve.

SUMMARY OF THE INVENTION

A main objective of the present invention is to provide a door curtain anti-dropping device for an electric rolling door, wherein when a door operator is running, the door curtain anti-dropping device detects the rotational speed of a winding shaft. Once an abnormal rotational speed of the winding shaft is detected, a brake mechanism locks the winding shaft immediately.

Another objective of the present invention is to provide a door curtain anti-dropping device for an electric rolling door, wherein the rotational speed of the winding shaft is reduced secondarily by a reducer mechanism to make the brake mechanism of the door curtain anti-dropping device lock the winding shaft by using a small braking force.

To attain the above objectives and other objectives, according to a door curtain anti-dropping device for an electric rolling door of the present invention, the electric rolling door comprises a door operator and a rolling door curtain. The door operator comprises a drive shaft, coupled to the winding shaft of the rolling door, the drive shaft driving the winding shaft to wind or unwind the door curtain of the rolling door. The door curtain anti-dropping device comprises: a first rotating shaft, one end of which is coupled to the winding shaft of the rolling door curtain and driven together with the winding shaft; a reducer mechanism, including an input end and an output end, the input end coupled to the other end of the first rotating shaft, the reducer mechanism used for reducing the rotational speed of the first rotating shaft; a brake mechanism, comprising a central shaft, a linkage disc, a first movable brake disc, an elastic element and an electromagnetic generator, the central shaft firmly connected to a housing, the linkage disc pivoted on the central shaft and coupled to the output end of the reducer mechanism, the linkage disc being rotatable with respect to the central shaft, the first movable brake disc pivoted on the central shaft and constantly receiving an elastic force from the elastic element to push and brake the linkage disc, the electromagnetic generator firmly disposed on one side of the first movable brake disc, the electromagnetic generator electrically excited to attract the first movable brake disc; a rotational speed detecting module, comprising at least one detector, disposed on one side of the linkage disc, for detecting the rotational speed of the linkage disc; and a control circuit, electrically connected to the electromagnetic generator and the rotational speed detecting module.

Accordingly, when the door operator is running, the control circuit controls the electromagnetic generator to be electrically excited so as to attract the first movable brake disc, and then to release the linkage disc and to drive the first rotating shaft and the winding shaft. Once the door curtain drops down abnormally, and an abnormal rotational speed of the linkage disc is detected by the rotational speed detecting module, the control circuit electrically switches off the electromagnetic generator to make the first movable brake disc of the brake mechanism brake the linkage disc so as to prevent the winding shaft from rotating continuously.

Preferably, the door curtain anti-dropping device for an electrical rolling door of present invention further comprises a centrifugal brake mechanism, disposed between the reducer mechanism and the brake mechanism. The centrifugal brake mechanism reduces the rotational speed of the first rotating shaft by a centrifugal force.

Furthermore, the input end of the reducer mechanism comprises a first wheel disc, disposed at the other end of the first rotating shaft. The reducer mechanism comprises a housing, a second rotating shaft, a plurality of primary planetary gears and a plurality of secondary planetary gears. On an inner wall of the housing, a first annular gear and a second annular gear are disposed. The plurality of primary planetary gears are equiangularly pivoted on one side end face of the first wheel disc via a plurality of shaft pins, and the plurality of primary planetary gears are engaged with the first annular gear. One end of the second rotating shaft comprises a first central gear, located at the central portion among the plurality of primary planetary gears and engaged with them. The other end of the second rotating shaft comprises a second wheel disc. The plurality of secondary planetary gears are equiangularly pivoted on one side end face of the second wheel disc via a plurality of shaft pins, and the plurality of secondary planetary gears are engaged with the second annular gear. The output end of the reducer mechanism comprises a second central gear, located at the central portion among the plurality of secondary planetary gears and engaged with them. Accordingly, the rotational speed of the winding shaft is secondarily reduced by the primary planetary gears and the secondary planetary gears. Therefore, the brake mechanism can lock the winding shaft by only using a small braking force.

Also, the brake mechanism further comprises a second movable brake disc and a brake pad. The second movable brake disc is sleeved on the central shaft and located on one side of the linkage disc. The second movable brake disc is movable axially. The brake pad can be rotatably pivoted on the central shaft and located between the first movable brake disc and the second movable brake disc. The end face of the linkage disc facing the second movable brake disc is provided with a plurality of guide rods. The brake pad is put on the plurality of guide rods. The brake pad can slide axially along the plurality of guide rods, and the brake pad is rotated together with the linkage disc. The electromagnetic generator surrounds the central shaft. The electromagnetic generator includes a through hole at its central portion. At a bottom portion of the through hole, a thrust bearing is provided. The elastic element is received within the through hole. One end of the elastic element abuts on the thrust bearing, and the other end storing an elastic force abuts on the first movable brake disc. Two side end faces of the second movable brake disc are each provided with a brake lining for braking the linkage disc and the brake pad, respectively, and the end face of the first movable brake disc facing the brake pad is also provided with a brake lining for braking the brake pad. Accordingly, when the control circuit electrically switches off the electromagnetic generator, the first movable brake disc is pushed by the elastic force of the elastic element, so as to push against the brake pad and the second movable brake disc toward the linkage disc, and then to clamp the first movable brake disc, the brake pad, the second movable brake disc and the linkage disc together, thereby creating a progressive three-stage brake effect.

Preferably, the detector of the rotational speed detecting module is provided outside the linkage disc for detecting its rotational speed. The detector can be selected from one of an optoelectronic switch, a Hall magnetic force sensor, a miniature toggle switch and a reflective optoelectronic sensor.

Preferably, the brake mechanism further comprises a brake releasing mechanism, which can be manually operated to separate the first movable brake disc from the brake pad, so as to loose the first movable brake disc and the linkage disc. Accordingly, it is convenient to unlock the winding shaft at the first installation of the rolling door. Even though the winding shaft is locked under an abnormal condition in the future, the winding shaft can be easily unlocked in a manual operation, thereby solving the trouble of being necessary to dismantle the door operator in the prior art.

BRIEF DESCRIPTION OF THE DRAWINGS

FIGS. 6 and 6*a* are the prior art transferred from U.S. Pat. No. 7,686,150, wherein FIG. 6 shows an appearance of a door curtain anti-dropping device, and FIG. 6*a* shows a detailed structure of the door curtain anti-dropping device of FIG. 6.

DESCRIPTION OF THE PREFERRED EMBODIMENTS

Figure 1:
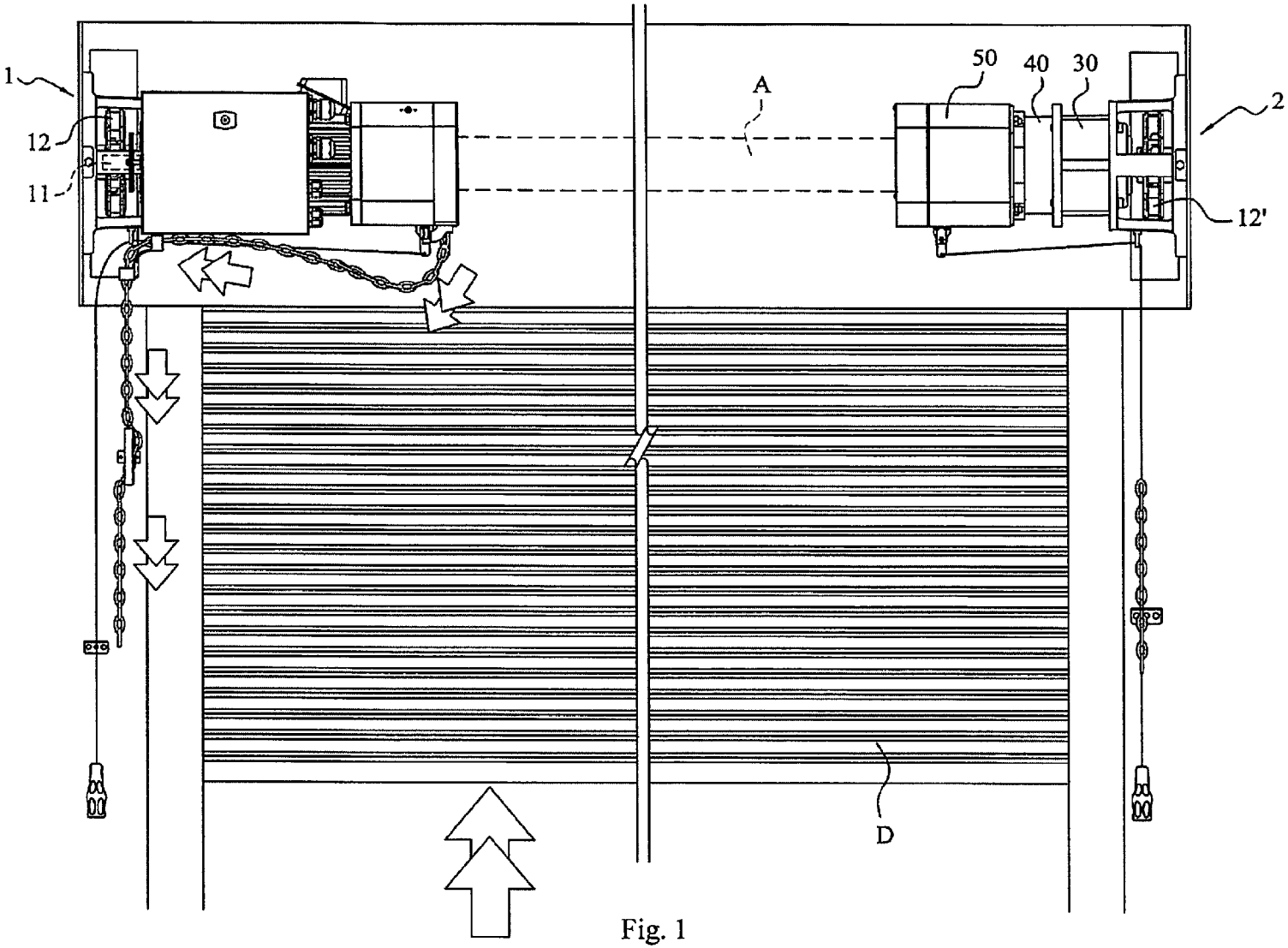
FIG. 1 is a schematic view showing a door curtain anti-dropping device of the present invention is used in a conventional electric rolling door with its door operator.
Figures 2, 2A:
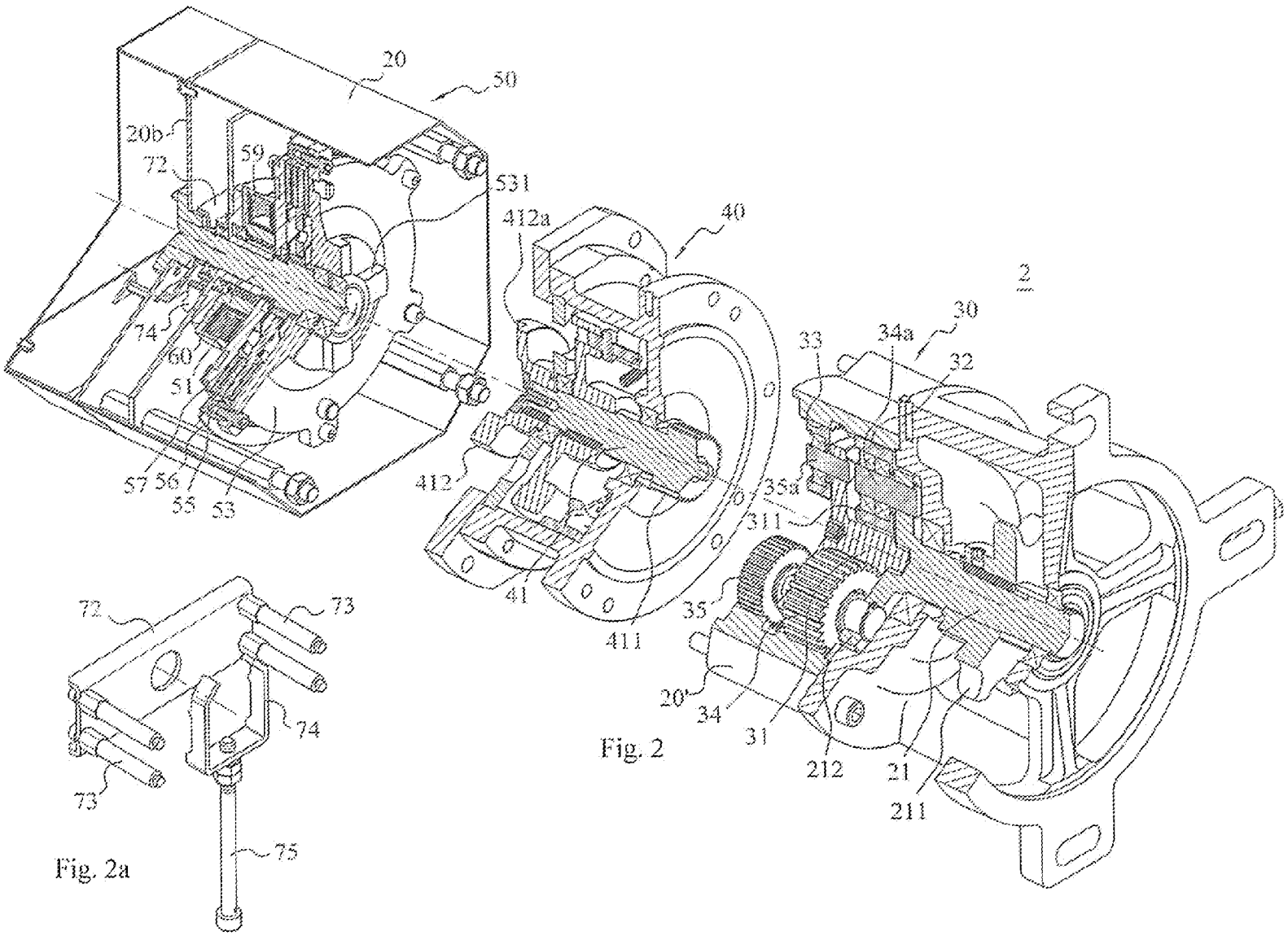
FIG. 2 is an exploded perspective view showing the door curtain anti-dropping device, wherein the door curtain anti-dropping device is sectioned.
FIG. 2*a* is an exploded perspective view showing part of elements of a manual brake release mechanism.
Figure 3:
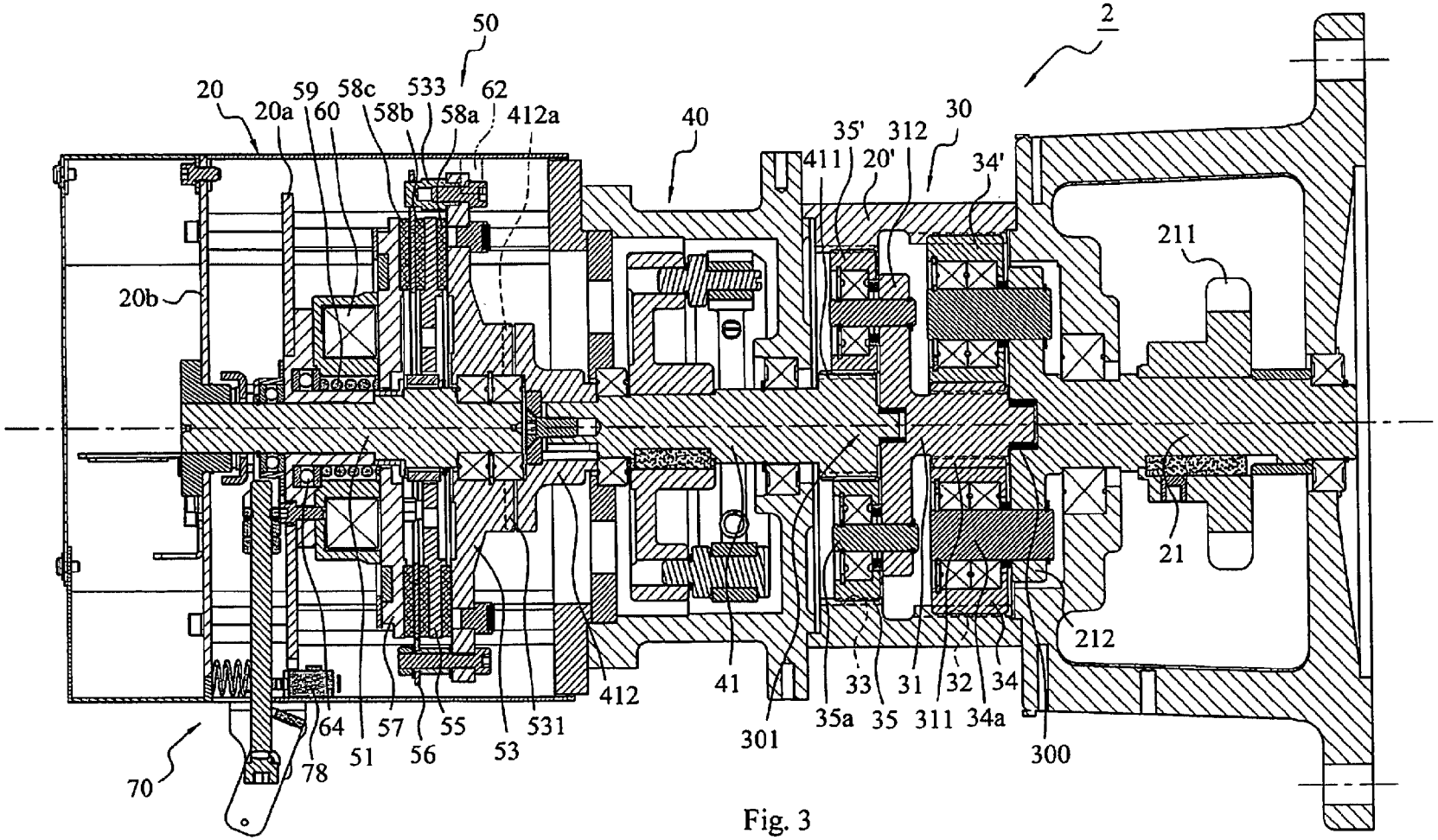
FIG. 3 is a sectional view showing the assembly of the door curtain anti-dropping device of FIG. 2.

First, referring to FIGS. 1 to 3, a preferred embodiment of a door curtain anti-dropping device for an electric rolling door is explained. As shown in the figure I, a conventional electric rolling door basically comprises: a door operator 1 and a rolling door curtain D. The rolling door curtain D includes a winding shaft A and a plurality of serially connected door slats wound about the winding shaft A. The door operator 1 comprises a drive shaft 11, coupled to a first end of a winding shaft A of the rolling door curtain D via a chain 12, for driving the winding shaft A to wind up or unwind the door slats.

Support basis can be found in FIG. 1.

As shown in FIGS. 1, 2, 2*a* and 3, a door curtain anti-dropping device 2 of the present invention comprises: at least one housing 20; a first rotating shaft 21, a first end of which is provided with a driven gear 211, which is coupled to a second end of the winding shaft A, for example, via a chain 12' to drive the winding shaft A. A reducer mechanism 30 comprises an input end 300 and an output end 301. The input end 300 is coupled to the other end of the first rotating shaft 21. The reducer mechanism 30 is used to reduce the rotational speed of the first rotating shaft 21, wherein the input end 300 of the reducer mechanism 30 includes a first wheel disc 212, disposed at the other end of the first rotating shaft 21.

The reducer mechanism 30 is received in a housing 20'. On a right inner wall of the housing 20', a first annular gear 32 is provided, and on a left inner wall of the housing 20', a second annular gear 33 is provided, the first and second annular gears being spaced apart a distance. The reducer mechanism 30 comprises a second rotating shaft 31, a plurality of primary planetary gears 34, 34' and a plurality of secondary planetary gears 35, 35'. The second rotating shaft 31 passes through the central portion of the reducer mechanism 30. The plurality of primary planetary gears 34, 34' are equiangularly pivoted on one left side end face of the first wheel disc 212 via a plurality of shaft pins 34*a*, the plurality of primary planetary gears 34, 34' being engaged with the first annular gear 32. The first end of the second rotating shaft 31 includes a first central gear 311, located at the center among the plurality of primary planetary gears 34, 34' and engaged with them. The other end of the second rotating shaft 31 comprises a second wheel disc 312. The plurality of secondary planetary gears 35, 35' are equiangularly pivoted on one left side end of the second wheel disc 312 via a plurality of shaft pins 35*a*, the plurality of secondary planetary gears 35, 35' being engaged with the second annular gear 33. Also, the output end 301 of the reducer mechanism is coupled with a third rotating shaft 41. A first end of the third rotating shaft 41 includes a second central gear 411, located at the central portion of the plurality of secondary planetary gears 35, 35' and engaged with them. The rotational speeds of the second rotating shaft 31 and the third rotating shaft 41 are reduced by the plurality of primary planetary gears 34, 34' and the plurality of secondary planetary gears 35, 35'.

A centrifugal braking mechanism 40 is disposed around the third rotating shaft 41, a second end of the third rotating shaft 41 being provided with a shaft coupling 412, and on a left side end face of the shaft coupling 412, a connecting portion 412*a* being provided. The centrifugal brake mechanism 40 governs rotational speed of the third rotating shaft 41 by centrifugal force. When the rotational speed of the third rotating shaft 41 exceeds a predetermined value (for example, 1800 rpm), it is limited by a friction force occurred on the inner wall of the housing by the centrifugal force.

A brake mechanism 50 is comprised of a central shaft 51, a linkage disc 53, a first brake disc 55, a second brake disc 57, an elastic element 59 and an electromagnetic generator 60. A first end of the central shaft 51 is free, and a second end thereof is secured to an end plate 20*b* which is firmly connected with the housing 20. The linkage disc 53 pivots on the first end of the central shaft 51. A right side end face of the linkage disc 53 is provided with a shaft coupling portion 531 for coupling to the connecting portion 412*a* of the shaft coupling 412, and hence the linkage disc 53 rotates together with the third rotating shaft 41. The first brake disc 55 and the second brake disc 57 are sleeved on the central shaft 51 to move axially, and the first brake disc 55 is located between the linkage disc 53 and the second brake disc 57. Furthermore, the brake mechanism 50 comprises a brake pad 56, which is slidably sleeved on the central shaft 51, and located between the first brake disc 55 and the second braking disc 57. On a left side end face of the linkage disc 53, a plurality of guide rods 533 are provided. The brake pad 56 can slid axially along the plurality of guide rods 533, and the brake pad 56 is rotated together with the linkage disc 53. Two side end faces of the first brake disc 55 are each provided with brake linings 58*a*, 58*b* for abutting against the linkage disc 53 and the brake pad 56, respectively, and a right side end face of the second braking disc 57 is also provided with a brake lining 58*c* for abutting against the brake pad 56.

The electromagnetic generator 60 faces the second brake disc 57, surrounds the central shaft 51 and is firmly disposed on a partition plate 20*a* which is secured together with the housing 20. The electromagnetic generator 60 has a through hole at its central portion. At the bottom portion of the through hole, a thrust bearing 64 is provided, and the elastic element 59 is received within this through hole. By way of one end of the elastic element 59 pressing against the thrust bearing 64, and the other end pressing against the second brake disc 57, the brake pad 56, the first brake disc 55 and the linkage disc 53 are stacked together. By way of using the brake linings 58*a*, 58*b* on the left and right side end faces of the first brake disc 55 to press against the linkage disc 53 and the brake pad 56, respectively, and the brake lining 58*c* on the right side end face of the second brake disc 57 to press against the brake pad 56, there occurs a progressive three-staged brake effect. When the electromagnetic generator 60 is electrically excited, the second brake disc 57 is attracted and retracted. At the same time, the brake pad 56, the first brake disc 55 and the linkage disc 53 are loosen to release the brake effect.

Figure 4B:
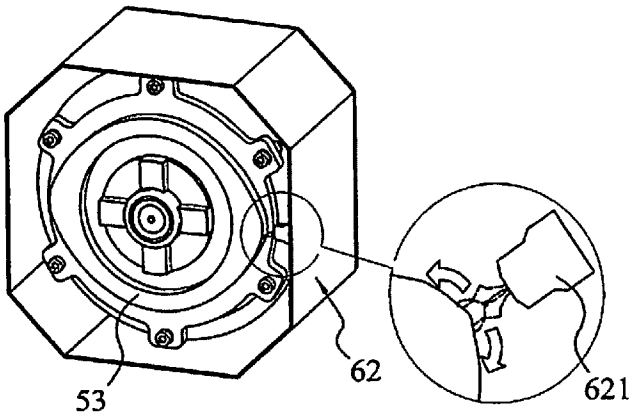
FIGS. 4 and 4*a*-4*c* are perspective views of the circled parts in a regular speed detecting module which is applied to the door curtain anti-dropping device of the present invention, wherein the circled part of FIG. 4 shows an optoelectronic switch, FIG. 4*a* a Hall magnetic force sensor, FIG. 4*b* a miniature toggle switch, and FIG. 4*c* a reflective optoelectronic sensor.
Figure 4:
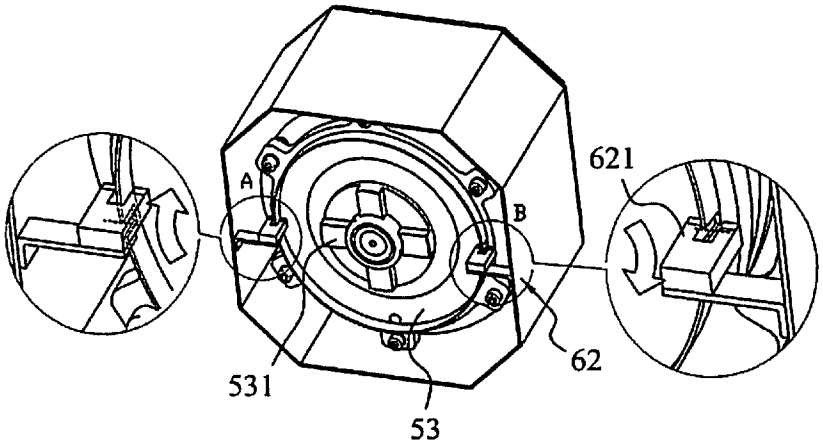
Figure 4C:
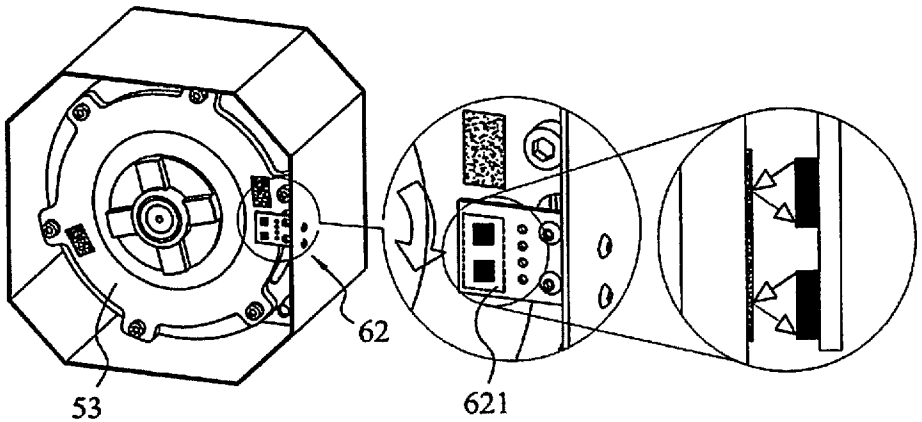
Figure 4A:
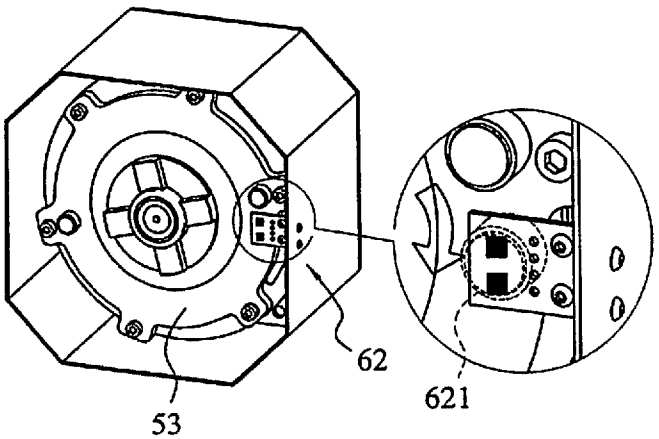

A rotational speed detecting module 62, as shown in FIGS. 4~4*c*, comprises at least one detector 621 for detecting rotational speed of the linkage disc 53, the detector 621 being disposed on one side of the linkage disc 53 and firmly connected to the housing 20. Preferably, the at least one detector 621 is, for example, selected from one of an optoelectronic switch (FIG. 4), a Hall magnetic force sensor (FIG. 4*a*), a miniature toggle switch (FIG. 4*b*) and a reflective optoelectronic sensor (FIG. 4*c*). The electromagnetic generator 60 and the rotational speed detecting module 62 are electrically connected through a control circuit.

As such, in the case that the electric rolling door is in a normal condition, and the door operator 1 is operated, the electromagnetic generator 60 is first excited by the control circuit so as to attract the brake disc 57, and release the linkage disc 53, and then the first rotating shaft 21 and the winding shaft A are driven by the door operator.

However, once the chain 12 of the door operator 1 is broken, which makes the door curtain D drop down, and the detector 621 detects that the rotational speed of the linkage disc 53 exceeds 1800 rpm (according to the gear ratio of the reducer mechanism 30, the rotational speed of the third rotating shaft 41 should be less than 1800 rpm), the control circuit can judge that the electric rolling door is in an abnormal condition, and switches off the electromagnetic generator 60 immediately, that is, the brake mechanism 50 is restored to brake state. Hence the winding shaft A is locked.

Moreover, the brake mechanism 50 preferably further comprises a brake-releasing mechanism 70 for manually separating the brake disc 57 from the brake pad 56, so as to loose the first brake disc 55 and the linkage disc 53.

Figure 5A:
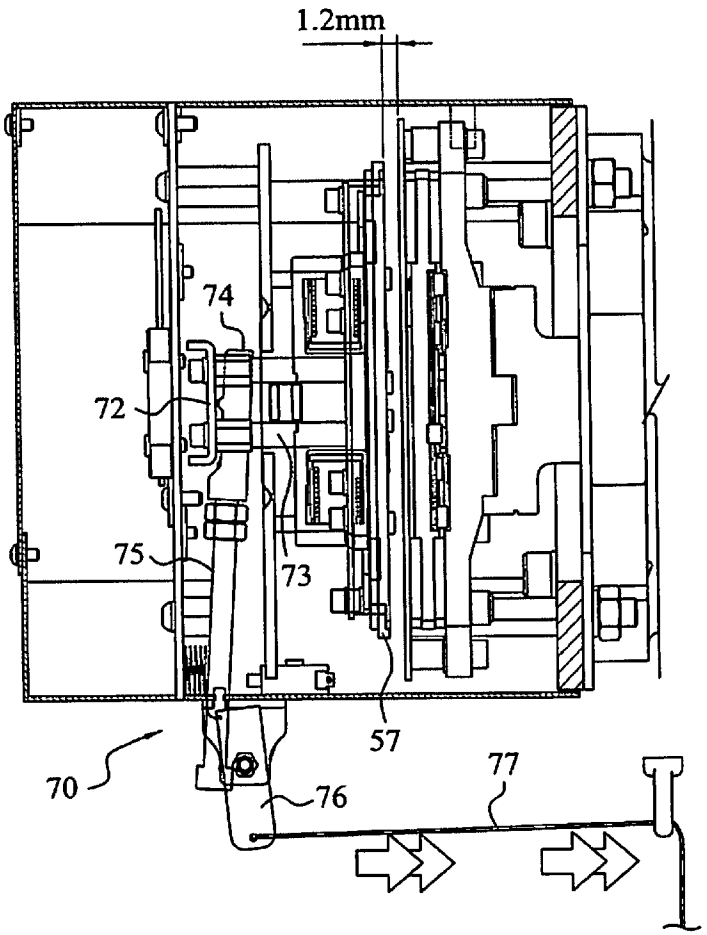
FIG. 5*a* shows that the brake state of the brake mechanism as shown in FIG. 5 is released by the manual brake releasing mechanism in FIG. 2*a;*
Figure 5:
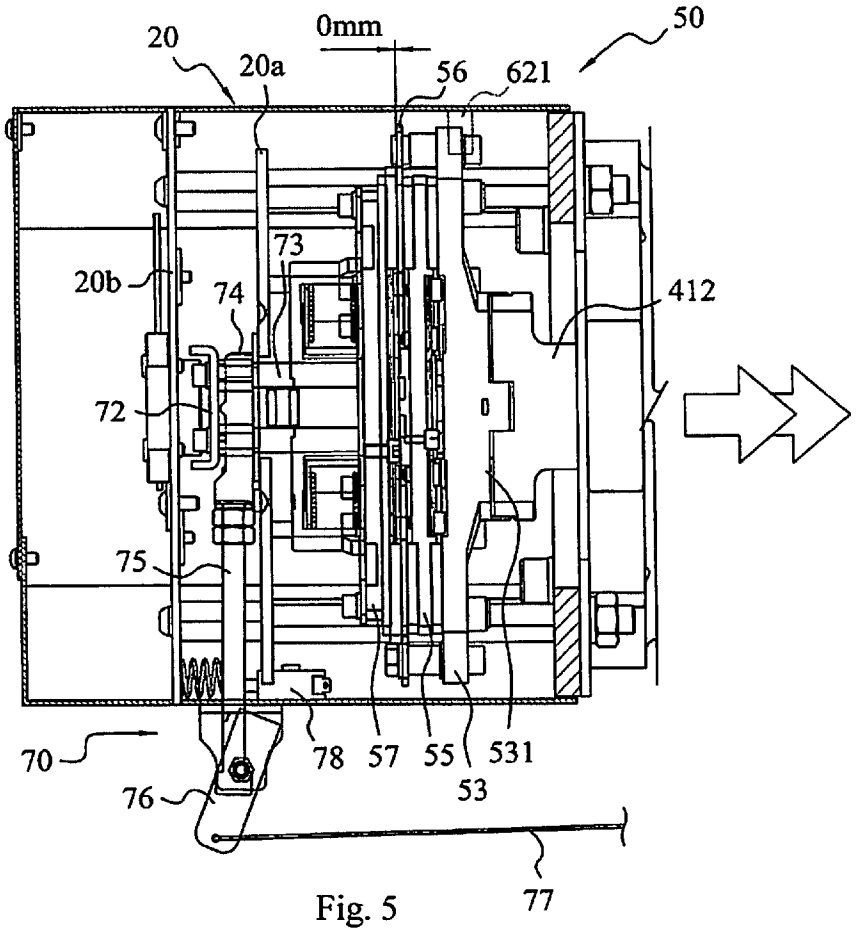
FIG. 5 is a schematic view showing a brake mechanism for the door curtain anti-dropping device of the present invention, wherein the brake mechanism is in brake state.
Figure 6A:
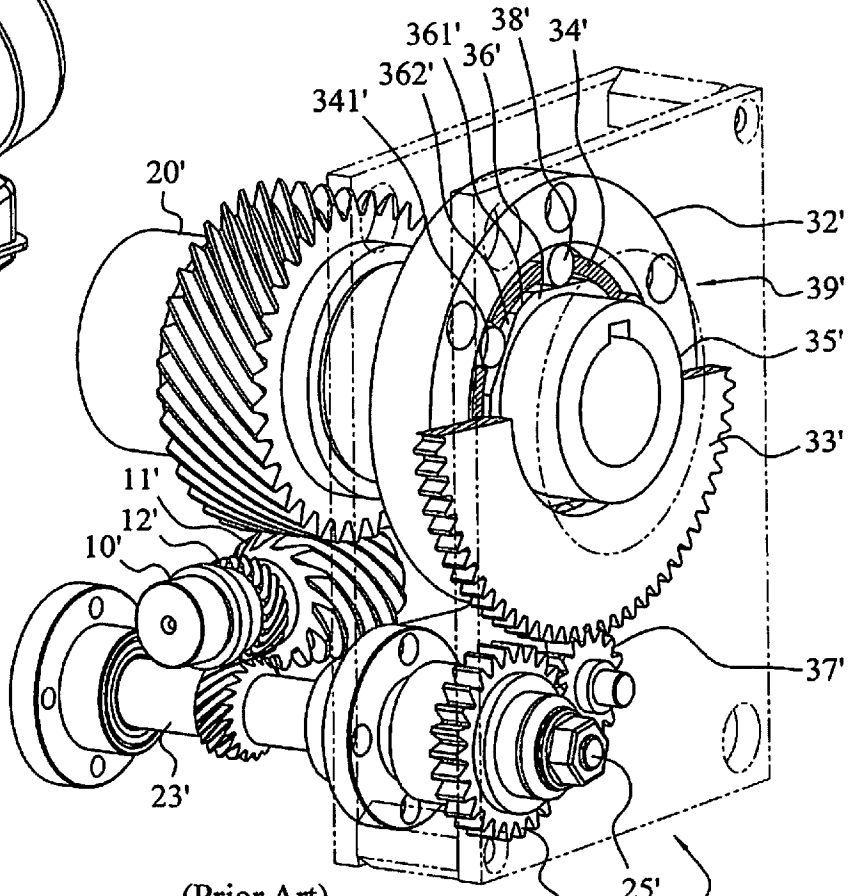
(Prior Art) Fig. 6a
Figure 6:
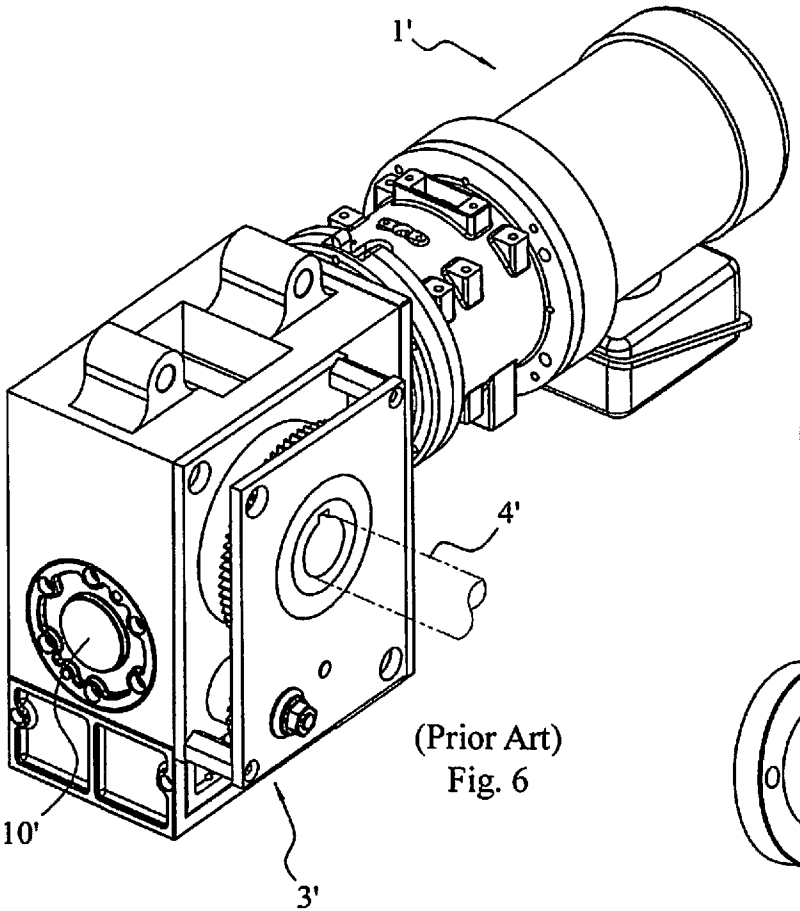
(Prior Art) Fig. 6

The brake-releasing mechanism 70 of the present invention is illustrated in FIGS. 5 and 5*a*. FIG. 5 shows that the brake mechanism 50 is in a brake lock state; and FIG. 5*a* shows that the brake-releasing mechanism 70 are actuated to make the brake mechanism 50 in a brake release state. As shown in FIGS. 2, 2*a*, 5 and 5*a*, the brake-releasing mechanism 70 is comprised of a U-shaped plate 72, a plurality of bolts 73, for example 4 bolts, a U-shaped member 74 and a draw bar 75. The U-shaped plate 72 can be axially movably sleeved on the central shaft 51, between the end plate 20*b* and the partition plate 20*a*. The ends of the bolts 73 are secured to the corners of the U-shaped plate 72 respectively, and the other ends thereof pass through the portion plate 20*a* to secure to the second brake disc 57, and hence the U-shaped plate 72 is connected with the second brake disc 57 together. One end of the U-shaped member 74 is branched as an U-shaped portion. The two branches are swingingly installed around the central shaft 51 between the U-shaped plate 72 and the partition plate 20*a*. A first end of the draw bar 75 is secured to the U-shaped portion, and a second end thereof extends outside the housing

20. When a force exerts on the second end of the draw bar 75, the U-shaped portion of the U-shaped member 74 abuts on the partition plate 20*a* and then push the U-shaped plate 72 through leverage further. Hence, the second brake disc 57 leaves away from the brake pad 56 to release the brake.

In addition, as shown in FIGS. 5 and 5*a*, the brake-releasing mechanism 70 is further comprised of a linkage plate 76, which is pivotally disposed on the housing 20, and a first end of the linkage plate 76 is connected with the second end of the draw bar 75; and a pull rope 77, one end of which is fastened to a second end of the linkage plate 76, the pull rope 77 extending to a place where one can manually operates the release brake.

When a rolling door is installed at the first time or a winding shaft A is locked in an abnormal condition in the future, the winding shaft A must be unlocked. First, the pull rope 77 is pulled, for example toward the right side, and fastened; the second end of the draw bar 75 is actuated by the swing of the linkage plate 76, which renders the U-shaped member 74 of the first end of the draw bar 75 to push the U-shaped plate 72 to slide left together with the second brake disc 57. Thereby, the brake is released. Moreover, the brake-releasing mechanism 70 further comprises a sensor switch 78. When a manual release brake is performed, the draw bar 75 can trigger the sensor switch 78, and then, the sensor switch 78 can switch off the door operator 1.

The preferred embodiments of the present invention are illustrative only, and are not limited to the details disclosed in the drawings and the specification. Many changes can be made by those having ordinary skill in the art without departing from the equivalent changes and modifications made by the claims of the present invention, and should belong to the scope of the prevent invention.

LIST OF REFERENCE NUMERALS

1 door operator
11 drive shaft
12, 12' chain
12' second gear
2 door curtain anti-dropping device
20, 20' housing
20' hollow shaft
20*a* partition plate
20*b* end plate
21 first rotating shaft
211 driven gear
212 first wheel disc
30 reducer mechanism
31 second rotating shaft
300 input end
301 output end
311 first central gear
312 second wheel disc
32 first annular gear
33 second annular gear
34, 34' primary planetary gear
34' tabs
34*a* shaft pins
35, 35' secondary planetary gears
35' shaft hub
35*a* shaft pins
40 centrifugal brake mechanism
41 third rotating shaft
411 second central gear
412 shaft coupling
412*a* connecting portion
50 brake mechanism
51 central shaft
53 linkage disc
531 shaft coupling portion
533 guide rods
55 fixed brake disc
56 brake pad
57 movable brake disc
58*a* brake lining
58*b* brake lining
58*c* brake lining
59 elastic element
60 electromagnetic generator
62 rotational speed detecting module
621 detector
64 thrust bearing
70 brake-releasing mechanism
72 U-shaped plate
73 bolts
74 U-shaped member
75 draw bar
76 linkage plate
77 pull rope
78 sensor switch
A winding shaft
D rolling door curtain

What is claimed is:

1. A door curtain anti-dropping device for a rolling door, the electric rolling door comprising a door operator (1) and a door curtain (D) having a winding shaft (A) and a plurality of serially connected door slats wound about the winding shaft, the door operator (1) comprising a driving shaft (11) coupled to a first end of the winding shaft (A) to wind or the plurality of door slats, the door curtain anti-dropping device comprising:

a first rotating shaft (21) having one end coupled to a second end of the winding shaft (A) of the door curtain (D) and driven together with the winding shaft (A);

a reducer mechanism (30) for reducing the rotational speed of the first rotating shaft (21), the reducer mechanism having an output end (301) and an input end (300) coupled to the other end of the first rotating shaft (21);

a brake mechanism (50) comprising a central shaft (51), a linkage disc (53), a first movable brake disc (57), an elastic element (59) and an electromagnetic generator (60), the central shaft (51) firmly connected to a housing (20), the linkage disc (53) pivoted on the central shaft (51) and coupled to the output end (301) of the reducer mechanism (30), the linkage disc (53) being rotatable with respect to the central shaft (51), the first movable brake disc (57) pivoted on the central shaft (51) and constantly receiving an elastic force from the elastic element (59) to push and brake the linkage disc (53), the electromagnetic generator (60) disposed on one side of the first movable brake disc (57), the electromagnetic generator (60) electrically excited to attract the first movable brake disc (57);

a rotational speed detecting module (62) comprising at least one detector (621) disposed on one side of the linkage disc (53), for detecting a rotational speed of the linkage disc (53); and a control circuit electrically connected to the electromagnetic generator (60) and the rotational speed detecting module (62), wherein, when the door operator (1) is running, the control circuit electrically excites the electromagnetic generator (60) so as to attract the first movable brake disc (57), and then to release the linkage disc (53) and to drive the first rotating shaft (21) and the winding shaft (A); and when the door slats drop down and the detector of the rotational speed detecting module detects that the linkage disc (53) rotates at a speed higher than a predetermined speed, the control circuit is activated to cut off the power of the electromagnetic generator (60) so that the first movable brake disc (57) of the brake mechanism (50) brakes the linkage disc (53) to prevent the winding shaft (A) from rotating continuously.

2. The door curtain anti-dropping device as claimed in claim 1, further comprising a centrifugal brake mechanism (40) disposed between the reducer mechanism (30) and the brake mechanism (50) to reduce the rotational speed of the first rotating shaft (21) by a centrifugal force.

3. The door curtain anti-dropping device as claimed in claim 1, wherein the input end (300) of the reducer mechanism (30) comprises a first wheel disc (212) disposed at the other end of the first rotating shaft (21); the reducer mechanism (30) comprises a housing (20'), a second rotating shaft (31), a plurality of primary planetary gears (34, 34') and a plurality of secondary planetary gears (35, 35'), on an inner wall of the housing (20'), a first annular gear (32) and a second annular gear (33) are disposed; the plurality of primary planetary gears (34, 34') are equiangularly pivoted on one side end face of the first wheel disc (212) via a plurality of shaft pins (34*a*), and the plurality of primary planetary gears (34, 34') are engaged with the first annular gear (32); one end of the second rotating shaft (31) comprises a first central gear (311), arranged in between the plurality of primary planetary gears (34, 34') so as to engage the primary planetary gears, the other end of the second rotating shaft (31) comprises a second wheel disc (312); the plurality of secondary planetary gears (35, 35') are equiangularly pivoted on one side end face of the second wheel disc (312) via a plurality of shaft pins (35*a*), and the plurality of secondary planetary gears (35, 35') are engaged with the second annular gear (33); the output end (301) of the reducer mechanism (30) comprises a second central gear (411) arranged in between the plurality of secondary planetary gears (35, 35') so as to engage the secondary planetary gears.

4. The door curtain anti-dropping device as claimed in claim 1, wherein the brake mechanism (50) further comprises a second movable brake disc (55) and a brake pad (56), the second movable brake disc (55) is sleeved on the central shaft (51) and located on one side of the linkage disc (53), the second movable brake disc (55) being movable axially; the brake pad (56) is rotatably pivoted on the central shaft (51) and located between the first movable brake disc (57) and the second movable braking disc (55); the end face of the linkage disc (53) facing the second movable brake disc (55) is provided with a plurality of guide rods (533), the brake pad (56) is put on the plurality of guide rods (533), the brake pad (56) is axially slidable along the plurality of guide rods (533), and the brake pad (56) is rotated together with the linkage disc (53), wherein when the control circuit electrically disconnects the electromagnetic generator (60), the first movable brake disc (57) is pushed by the elastic force of the elastic element (59), so that the first movable brake disc (57) pushes against the brake pad (56) and the second movable brake disc (55) toward the linkage disc (53) to clamp the first movable brake disc (57), the brake pad (56), the second movable brake disc (55) and the linkage disc (53) together.

5. The door curtain anti-dropping device as claimed in claim 4, wherein two side end faces of the second movable brake disc (55) are each provided with a first brake lining (58*a*, 58*b*) for braking the linkage disc (53) and the brake pad (56), respectively, and the end face of the first movable brake disc (57) facing the brake pad (56) is provided with a second brake lining (58*c*) for braking the brake pad (56).

6. The door curtain anti-dropping device as claimed in claim 4, wherein the electromagnetic generator (60) surrounds the central shaft (51), the electromagnetic generator (60) includes a through hole at the central portion thereof for receiving the elastic element (59), a thrust bearing (64) is provided at a bottom portion of the through hole, one end of the elastic element (59) abuts on the thrust bearing (64), and the other end storing an elastic force abuts on the first movable brake disc (57).

7. The door curtain anti-dropping device as claimed in claim 4, wherein the at least one detector (621) of the rotational speed detecting module (62) is selected from one of an optoelectronic switch, a Hall magnetic force sensor, a miniature toggle switch and a reflective optoelectronic sensor.

8. The door curtain anti-dropping device as claimed in claim 4, wherein the brake mechanism (50) further comprises a brake releasing mechanism (70) comprising a partition plate (20*a*), a U-shaped plate (72), a U-shaped member (74) and a draw bar (75), the partition plate (20*a*) being secured to the housing (20), the U-shaped plate (72) being firmly disposed on the central shaft (51) and linked with the brake disc (57), the U-shaped member (74) being disposed between the U-shaped plate (72) and the partition plate (20*a*), one end of the draw bar (75) being firmly connected to the U-shaped portion, the other end thereof extending outside the housing (20); when the other end of the draw bar (75) is moved, one end of the U-shaped member (74) abuts against the partition plate (20*a*) and the other end of the U-shaped member (74) pushes against the U-shaped plate (72), so as to make the first movable braking disc (57) away from the brake pad (56), thereby releasing the brake.

9. The door curtain anti-dropping device as claimed in claim 8, wherein the brake releasing mechanism (70) further comprises a sensor switch (78) disposed on one side of the draw bar (75) and electrically connected to the door operation (1); and when the draw bar (75) is moved, the draw bar (75) triggers the sensor switch (78), and then, the sensor switch (78) transmits a signal to switch off the door operator (1).

10. A door curtain anti-dropping device for an electric rolling door, the electric rolling door comprising a door operator and a door curtain having a winding shaft and a plurality of serially connected door slats wound about the winding shaft, the door operator comprising a driving shaft coupled to a first end of the a winding shaft to wind or unwind the plurality of door slats, the door curtain anti-dropping device comprising:

a first rotating shaft having one end coupled to a second end of the winding shaft of the door curtain and driven together with the winding shaft;

a reducer mechanism having an output end and an input end coupled to the other end of the first rotating shaft to reduce a rotational speed of the first rotating shaft;

a brake mechanism comprising a central shaft is connected to a housing, a linkage disc pivoted on and rotatable with respect to the central shaft and coupled to the output end of the reducer mechanism, a first movable brake disc pivoted on the central shaft and constantly receiving an elastic force from the elastic element to push and brake the linkage disc, and an electromagnetic generator disposed on one side of the first movable brake disc and electrically excited to attract the first movable brake disc;

a rotational speed detecting module disposed on one side of the linkage disc to detect a rotational speed of the linkage disc; and a control circuit electrically connected to the electromagnetic generator and the rotational speed detecting module to control the electromagnetic generator and prevent the winding shaft from rotating continuously, wherein, when the door operator is running, the control circuit electrically excites the electromagnetic generator so as to attract the first movable brake disc, and then release the linkage disc and to drive the first rotating shaft and the winding shaft, and wherein, when the door slats drop down and the rotational speed detecting module detects that the linkage disc rotates at a speed higher than a predetermined speed, the control circuit cuts off the power of the electromagnetic generator so that the first movable brake disc of the brake mechanism brakes the linkage disc to prevent the winding shaft from rotating continuously.

11. The door curtain anti-dropping device as claimed in claim 10, further comprising a centrifugal brake mechanism disposed between the reducer mechanism and the brake mechanism to reduce the rotational speed of the first rotating shaft by a centrifugal force.

12. The door curtain anti-dropping device as claimed in claim 10, wherein the input end of the reducer mechanism comprises a first wheel disc disposed at the other end of the first rotating shaft;

wherein the reducer mechanism comprises a housing, a second rotating shaft, a plurality of primary planetary gears and a plurality of secondary planetary gears on an inner wall of the housing, a first annular gear and a second annular gear disposed thereon;

wherein the plurality of primary planetary gears are equiangularly pivoted on one side end face of the first wheel disc, via a plurality of shaft pins, and are engaged with the first annular gear;

wherein one end of the second rotating shaft comprises a first central gear arranged in between the plurality of primary planetary gears so as to engage the primary planetary gears, and the other end of the second rotating shaft comprises a second wheel disc;

wherein the plurality of secondary planetary gears are equiangularly pivoted on one side end face of the second wheel disc, via a plurality of shaft pins, and are engaged with the second annular gear; and wherein the output end of the reducer mechanism comprises a second central gear arranged in between the plurality of secondary planetary gears so as to engage the secondary planetary gears.

13. The door curtain anti-dropping device as claimed in claim 10, wherein:

the brake mechanism further comprises a brake pad and a second movable brake disc sleeved on the central shaft and located on one side of the linkage disc to move axially;

the brake pad is rotatably pivoted on the central shaft and located between the first movable brake disc and the second movable braking disc;

the end face of the linkage disc facing the second movable brake disc is provided with a plurality of guide rods;

the brake pad is put on the plurality of guide rods, axially slidable along the plurality of guide rods, and is rotated together with the linkage disc; and when the control circuit electrically disconnects the electromagnetic generator, the first movable brake disc is pushed by the elastic force of the elastic element so that the first movable brake disc pushes against the brake pad and the second movable brake disc toward the linkage disc to clamp the first movable brake disc, the brake pad, the second movable brake disc and the linkage disc together.

14. The door curtain anti-dropping device as claimed in claim 13, wherein two side end faces of the second movable brake disc are each provided with a first brake lining for braking the linkage disc and the brake pad respectively, and the end face of the first movable brake disc facing the brake pad is provided with a second brake lining for braking the brake pad.

15. The door curtain anti-dropping device as claimed in claim 13, wherein:

the electromagnetic generator surrounds the central shaft and includes a through hole at its central portion thereof for receiving the elastic element, a thrust bearing is provided at a bottom portion of the through hole with one end of the elastic element abuts on the thrust bearing, and the other end storing an elastic force abuts on the first movable brake disc.

16. The door curtain anti-dropping device as claimed in claim 13, wherein the rotational speed detecting module comprises at least one of an optoelectronic switch, a Hall magnetic force sensor, a miniature toggle switch and a reflective optoelectronic sensor.

17. The door curtain anti-dropping device as claimed in claim 13, wherein the brake mechanism further comprises a brake releasing mechanism comprising a partition plate secured to the housing, a U-shaped plate disposed on the central shaft and linked with the brake disc, a U-shaped member disposed between the U-shaped plate and the partition plate, and a draw bar having one end connected to the U-shaped portion and the other end extending outside the housing; and when the other end of the draw bar is moved, one end of the U-shaped member abuts against the partition plate and the other end of the U-shaped member pushes against the U-shaped plate so as to make the first movable braking disc away from the brake pad, thereby releasing the brake.

18. The door curtain anti-dropping device as claimed in claim 17, wherein the brake releasing mechanism further comprises a sensor switch disposed on one side of the draw bar and electrically connected to the door operation, and when the draw bar is moved, the draw bar triggers the sensor switch and then, the sensor switch transmits a signal to switch off the door operator.

* * * * *